US008567434B2

(12) United States Patent
Ericson et al.

(10) Patent No.: US 8,567,434 B2
(45) Date of Patent: Oct. 29, 2013

(54) CLOSING AND SEALING MEANS FOR AIR ADMITTANCE VALVES IN SANITARY WASTE WATER PIPE SYSTEMS

(75) Inventors: Kurt Sture Birger Ericson, Schilde (BE); Han Sin Low, Sungei Buloh (MY)

(73) Assignee: Studor S.A., Luxembourg (LU)

( * ) Notice: Subject to any disclaimer, the term of this patent is extended or adjusted under 35 U.S.C. 154(b) by 233 days.

(21) Appl. No.: 13/203,004

(22) PCT Filed: Feb. 17, 2010

(86) PCT No.: PCT/BE2010/000010
§ 371 (c)(1),
(2), (4) Date: Aug. 24, 2011

(87) PCT Pub. No.: WO2010/096885
PCT Pub. Date: Sep. 2, 2010

(65) Prior Publication Data

US 2011/0308632 A1 Dec. 22, 2011

(30) Foreign Application Priority Data

Feb. 25, 2009 (EP) ..... 09447002

(51) Int. Cl.
*F16K 24/04* (2006.01)
*E03C 1/295* (2006.01)
*E03C 1/122* (2006.01)

(52) U.S. Cl.
USPC ..... 137/526; 137/217; 251/362

(58) Field of Classification Search
USPC ..... 137/215, 216, 216.2, 217, 526; 251/362
See application file for complete search history.

(56) References Cited

U.S. PATENT DOCUMENTS

| | | | | |
|---|---|---|---|---|
| 4,232,706 | A | 11/1980 | Ericson | |
| 5,048,562 | A * | 9/1991 | Frawley | 137/516.15 |
| 6,786,471 | B2 * | 9/2004 | Nakata et al. | 251/331 |

FOREIGN PATENT DOCUMENTS

| | | | |
|---|---|---|---|
| BE | 831833 | A1 | 11/1975 |
| EP | 0 100 657 | A1 | 7/1983 |
| EP | 0 401 989 | A2 | 12/1990 |
| EP | 0 401 989 | A3 | 12/1990 |
| EP | 0 409 506 | A1 | 1/1991 |
| EP | 1 059 391 | A2 | 12/2000 |
| EP | 1 059 391 | A3 | 12/2000 |
| EP | 1 650 363 | A2 | 4/2006 |
| GB | 2 231 391 | A | 11/1990 |

* cited by examiner

*Primary Examiner* — John Rivell
*Assistant Examiner* — Kevin Barss
(74) *Attorney, Agent, or Firm* — Hovey Williams LLP

(57) ABSTRACT

The closing and sealing device for use in air admittance valves includes a valve housing (10) designed to be connected to the waste water pipe system, an upper cap (14) and a valve closing and sealing device which includes a fixed valve seat (22) and a movable closing member (24). The housing (10) includes at least one passageway (16) in communication with the surrounding atmospheric air, and at least one passageway (18) in connection with the inner space (19) of the sewage system, each of the passageways being in contact with the movable closing member (24). The closing device includes a rigid movable closing member in the shape of a poppet valve (40) having an inverted bowl shaped central part (42) provided, at its periphery, with an inverse angled conical surface (44) extending upwards and designed to co-operate with the sealing device which includes a fixed valve seat (22) having an upper edge provided with a soft annular seat (50) presenting a thin annular cantilever lip (52) extending towards the center of the seat (22).

16 Claims, 3 Drawing Sheets

CLOSING AND SEALING MEANS FOR AIR ADMITTANCE VALVES IN SANITARY WASTE WATER PIPE SYSTEMS

This is a national stage application of International Application PCT/BE2010/000010 filed 17 Feb. 2010, claiming priority from European Patent Office application 09447002.8 filed 25 Feb. 2009, the entire disclosures of which are incorporated herein by reference.

FIELD OF THE INVENTION

This invention is relating to closing and sealing means for use in air admittance valves connected to a sanitary waste water pipe system in order to protect the water traps in the system and to prevent communication between the air contained in waste water or sewers systems with surrounding atmosphere, said valve opens automatically to admit atmospheric air into the pipe system upon a sudden pressure drop or under-pressure peak within said pipe system.

By closing and sealing means it is to be understood, on the one hand, the movable closing member or membrane and, on the other hand, the fixed valve seat, co-operating with said closing member in a sealed off position of the valve.

A building drainage and vent system involves, in normal operating conditions, the establishment of an induced air flow within the vertical stacks of the system due to the unsteady water downfall generated by any sanitary appliance discharge. In order to protect the habitable space against contaminated odours, each appliance is normally protected by a water trap seal. Variation due to water downfall within the drainage system, generates occasional variations in air pressure (positive and/or negative) that are often capable of disturbing these water trap seals either by siphonage due to a sudden under-pressure in the system or as a result of back pressures following air path closures by water surcharge.

DESCRIPTION OF THE PRIOR ART

Air admittance valves have been introduced to avoid said inconveniences and also offers the possibility of avoiding the necessity to vent the waste pipe system outside the roof of the building as said valves only open in response to sub-atmospheric pressure conditions in the waste pipe system.

Said valves are designed to assure a maximum possible air inlet flow from the air inlet of the valve to the waste pipe system while passing through the temporary opened valve membrane.

Distinction is to be made between two major categories of air admittance valves; the first category comprising an annular closing member resting on two co-axial circular seats and the second category comprising a spherical or circular closing member resting on a corresponding peripheral seat.

One of the first automatic air admittance valves is disclosed in document BE 831.833.

A more recent patent document U.S. Pat. No. 4,232,706, in the name of the applicant, discloses an automatic valve device in which a vertical tube, constituting the body of the valve, comprises at its upper end a constriction in the form of a Venturi which co-operates with a cover so as to form a peripheral air inlet provided with an annular valve member situated at the exterior of the constriction and which can be tilted when a negative pressure occurs in the pipes while permitting the fresh air to penetrate into the vertical waste water pipe and which, when the pressure is equilibrated or when there is overpressure, occupies a closed position in which the escape of contaminated air is prevented. Said valve comprises an annular peripheral opening which distributes the air inlet, in case of lifting of the annular valve member, towards the vertical tube in connection with the waste pipe.

In valves of this kind, the circular or annular valve member is generally resting on two concentric valve seats having each a circular sealing surface. In case of deformation or distortion of the valve member, problems could occur with the necessary airtight closure of said valve member or membrane with at least one of the two sealing surfaces.

Document EP 0 409 506 discloses a valve device for admitting air to a pipe, comprising a body adapted to be mounted on the pipe, a chamber in the upper part of the body provided with at least one first passageway to the inner space of the pipe, a central circular closing member and a second passage way within the body for communication between the surrounding air and the chamber when the closing member is lifted. Said closing member being generally guided by guiding means such as a central rod. The sealing between the movable closing member and the seal has been realized either with an O-ring provided on the seal surface or a rubber disc provided on the closing member.

Document EP 1 650 363 disclosed an air admittance valve having basically the same structure as the above mentioned device. The seal element comprises an elastomer seal membrane maintained by an upper and a lower membrane support. The seal membrane rests on a sealing lip of the air inlet wall when the valve is in sealing position.

The manufacture of the closing member or membrane in known devices is generally complicated and expensive because it is made out of several elements of different composition, i.e. rigid and/or flexible material. Another major drawback of the existing air admittance valves is the accuracy of the sealing capacity between the closing member or membrane and the sealing surface or valve seat. Indeed, said sealing surface is mostly rigid or includes a fixed sealing ring (O-ring). Small variations in the flatness of the closing member and/or of the sealing surface, due to thermal or material deformations, may occur causing possible leakage's and release of contaminated air from the sewage system towards the surrounding atmosphere.

SUMMARY OF THE INVENTION

It is an object of the invention to provide an improved air admittance valve which is very simple and easy to manufacture while providing improved sealing capacities and sealing reliability.

The above objects are achieved in accordance with the characteristics of the present invention which are described more particularly in the annexed set of claims.

More details, advantages and features of the invention will appear from the following description of an embodiment of the valve according to the invention and in which reference is made to drawings in which:

DESCRIPTION OF THE PREFERRED EMBODIMENTS

Figure 1:
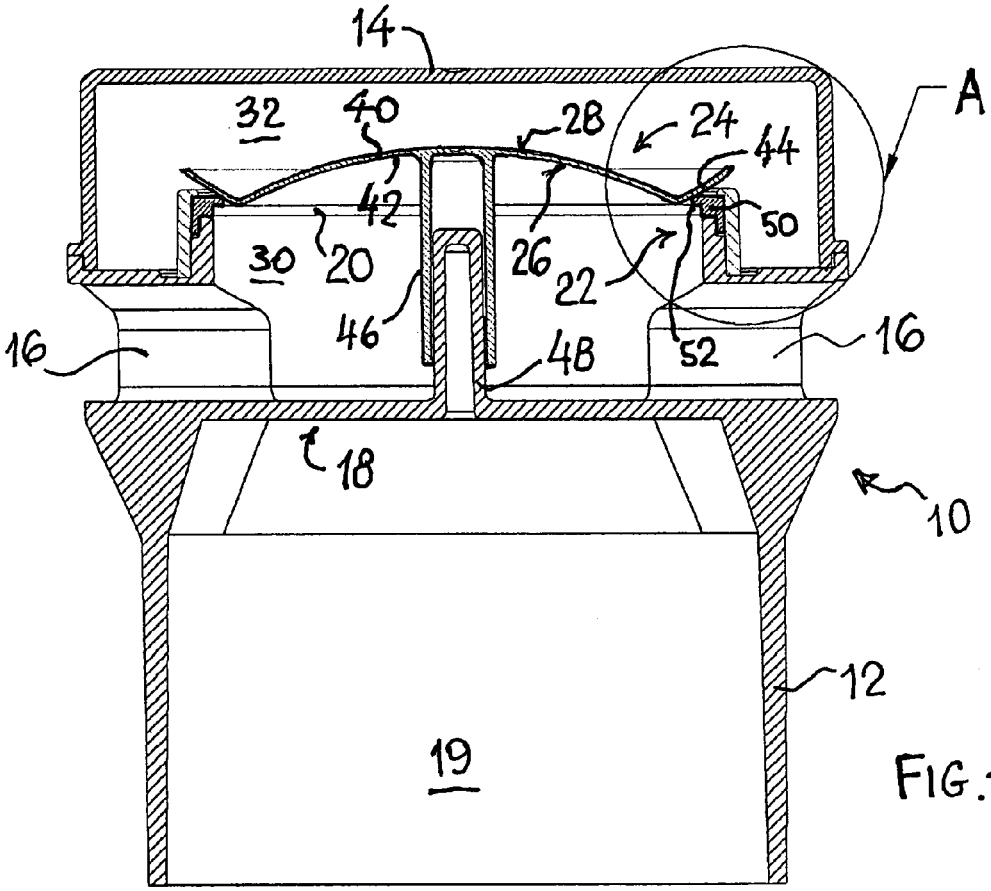
FIG. 1: is cross sectional view of a valve housing provided with sealing means according to the invention, showing the passageways towards the surrounding atmosphere.
Figure 3:
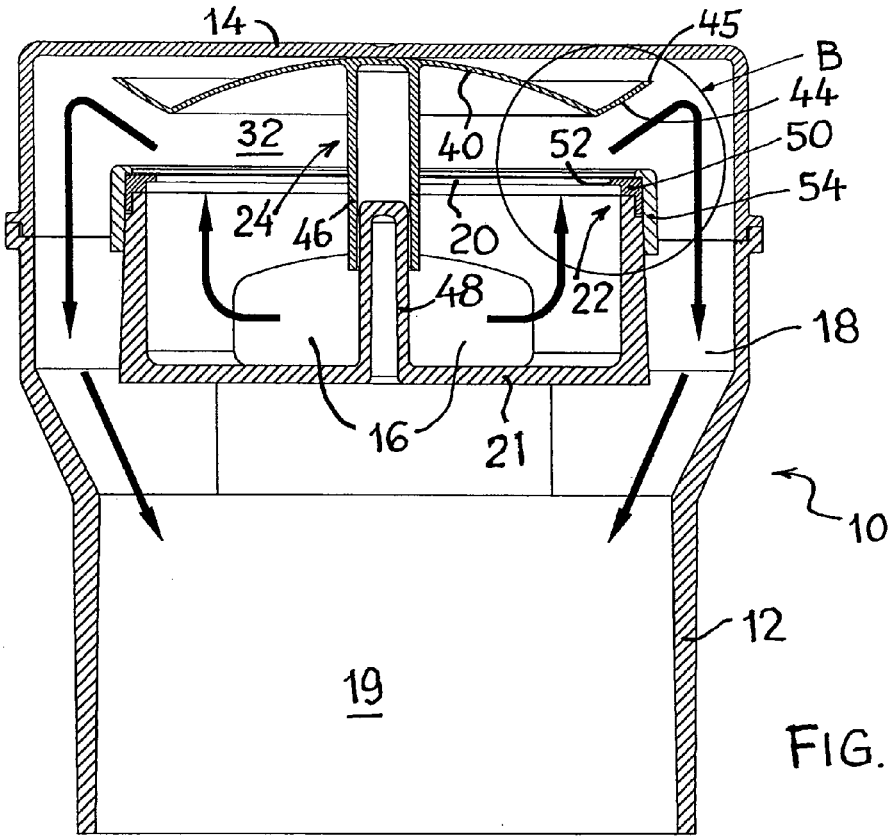
FIG. 3: is a cross sectional view of the same valve housing but taken in a plane perpendicular to one in FIG. 1, showing the passageways towards the inner space of the sewage system.

As shown in FIGS. 1 and 3, the valve comprises a classical air admittance valve housing 10 having a lower part comprising a vertical tubular member 12, with inner space 19, adapted to be connected to a vertical stack of a sanitary waste pipe (not shown) being part of a sewage system.

The upper part of the housing 10 is closed off with a cap or cover 14. Between the cover 14 and the tubular member 12, the housing is commonly provided with, on the one hand, passageways 16 towards the surrounding atmosphere and on the other hand, passageways 18 (FIG. 3) towards the inner space 19 of the tubular member 12 and consequently to the sewage system.

The passageways 16 and 18 are connected to each other by means of a central circular opening 20, the upper edge of which represents the fixed sealing member 22 designed to co-operate with a movable closing member 24.

The lower surface 26 of the movable closing member 24 is in contact with the space 30 in connection with the passageways 16 towards the surrounding atmosphere and the upper surface 28 of the movable closing member 24 is in contact with the space 32 within the upper cap 14 which is in connection with the passageways 18 towards the inner space 19 of the tubular member 12.

The passageways 16 and the inner space 30 is closed off from the inner space 19 of the tubular member 12 by means of a closing wall 21, part of the valve housing 10.

According to the invention, the movable closing member 24 is designed in the shape of a circular poppet valve 40 provided with an inverted bowl shaped central part 42 the lower surface of which is in permanent contact with the atmospheric air pressure. One can easily understand that the bowl shaped lower surface of the poppet valve 40 provides an increased surface in contact with the atmospheric air pressure and that, consequently, the lifting power of the closing member 24 will be significantly improved in case of negative pressure within the sewage system.

Figure 2:
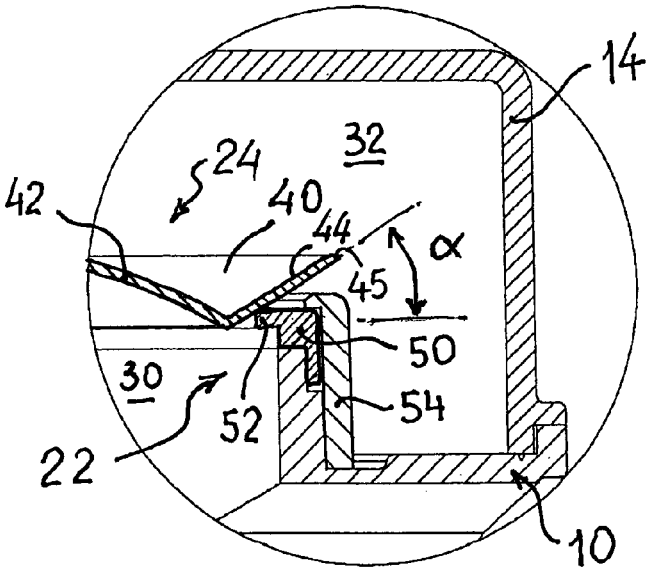
FIG. 2 is an enlarged view of detail A in FIG. 1 with the closing member in closed or sealed position.

Preferably, the bowl shaped central part 42 of the poppet valve 40 will be provided with a peripheral collar having an inverse angled conical surface 44, extending upwards towards an upper edge 45, under an angle $\alpha$ (FIG. 2). Such angle could be between 20° and 45°, and preferably about 30°.

The lower surface of the bowl shaped central part 42 is in contact with the surrounding atmosphere and will provide for an excellent lifting force of the valve 40 in case of sudden negative air pressure at the upper surface of the valve 40.

Figure 7:
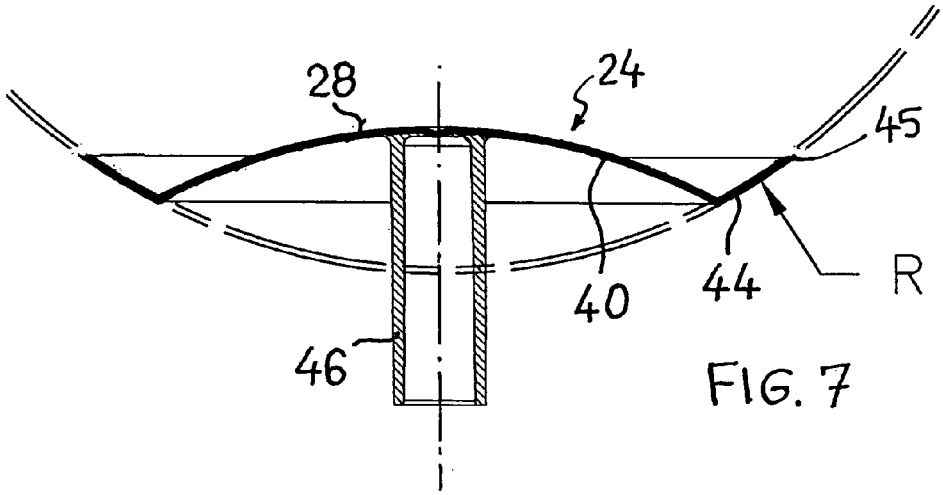
FIG. 7: is a detailed cross section of the poppet valve according to the invention.

In order to still improve the lifting force of the circular poppet valve 40, the inverse angled conical surface 44 of the valve is slightly curved following a circle with a radius R. Said radius R equals about the diameter of the valve seat opening 20 (see FIG. 7).

Preferably, the horizontal level of the top of the bowl shaped central part 42 will be situated in a higher position than the level of the upper edge 45 of the inverse angled conical surface 44.

Figure 6:
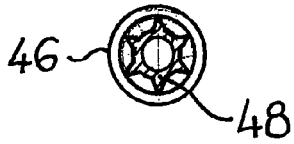
FIG. 6: is a sectional view along the line C-C in the FIG. 5 showing an example of the valve guiding means.

The lower surface of the bowl shaped inner part 42 is provided, in its centre, with a tubular extension 46, designed to co-operate as a guiding means with a stem 48 rigidly connected to the wall 21 of the valve housing 10. According to a preferred embodiment, the stem 48 is provided with a star shaped outer surface (as shown on the FIG. 6) so as to minimise the friction between the tubular extension 46 and the stem 48 and to avoid the poppet valve 40 to get stuck about the stem.

The poppet valve 40 can be manufactured in any suitable rigid plastic material such as polypropylene (PP) or ABS.

Also according to the present invention, the upper edge 22 of the central opening 20 is provided with a soft annular seat 50 having a thin annular cantilever platform or lip 52 extending towards the centre of the opening 20.

The soft annular seat 50 with cantilever lip 52 can be manufactured in any suitable rubber material such as nitril butadiene rubber (NBR) and is clamped to the valve seat 22 of the valve housing 10 by means of a rigid ring 54.

In view of firmly securing the soft annular seat 50 onto the upper edge 22 of the central opening 20, the rigid ring 54 may be provided with flexible fingers 55 extending downwards and provided, at their lower extremity, with a latch 56 designed to grip onto the lower surface of the closing wall 21 of the valve housing 10.

In a normal closed position (FIGS. 1 and 2) the poppet valve 40 is resting freely with its inverse angled conical surface 44 against the cantilever lip 52 of the soft annular seat 50 providing a secure sealing surface in normal (balanced) air pressure conditions.

Figure 4:
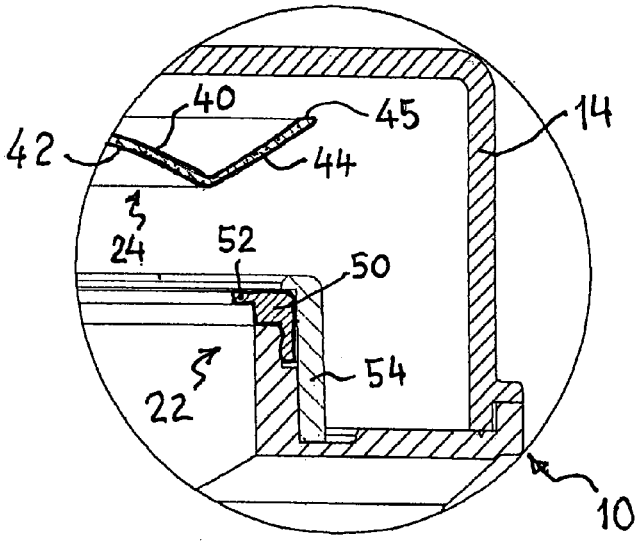
FIG. 4: is an enlarged view of detail B in FIG. 3 with the closing member in open or lifted position.
Figure 5:
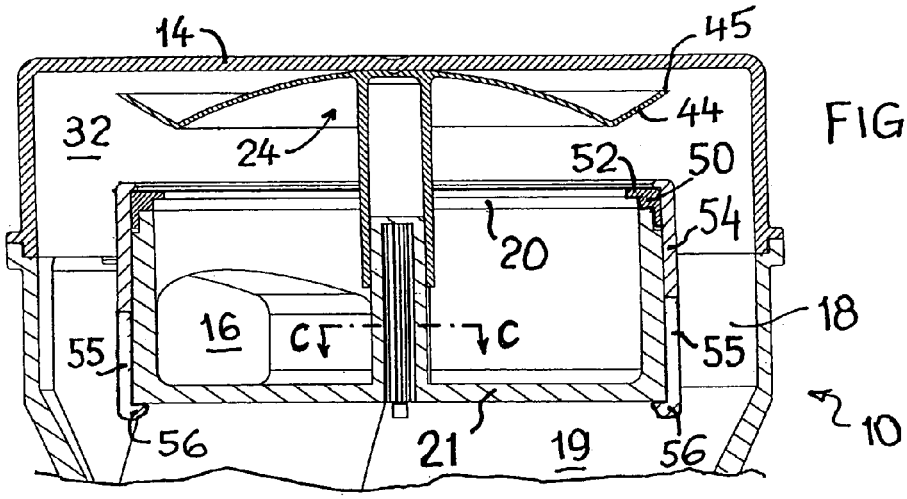
FIG. 5: is a partial sectional view identical to FIG. 3, showing some alternative constructional features.

In case of sudden negative pressure inside the sewage system, and as shown in FIGS. 3 and 4, the atmospheric air pressure will lift up the poppet valve 40 and atmospheric air will be instantaneously introduced into the sewage pipes. Upon equilibration of the air pressure within the sewage system, the poppet valve 40 will resume its closing position by gravity against the cantilever lip 52.

During the lifting up of the movable closing member 24, the inverse poppet valve 40 will be guided by means of the tubular extension 46 moving over the fixed stem 48 and dislodging will be prevented by abutment of the central upper portion 28 of the bowl shaped poppet valve 40 against the lower surface of the upper cap 14 of the valve housing 10.

In case of overpressure within the sewage system, the air contained in the inner space 19, the passageways 18 and the upper space 32 will push against the upper surface 28 of the poppet valve 40 causing the inverse angled conical surface 44 to press firmly against the cantilever lip 52 deforming it downwards while enlarging the sealing surface due to the inverse angled conical surface 44. In doing this, it becomes clear that, the greater the overpressure is, the greater the sealing surface will be providing increased sealing properties against overpressure in the sewage system.

From the above description of the invention, it becomes clear that major improvements have been achieved with respect to the existing state of the art closing and sealing elements within air admittance valves for use in sewage systems.

The main advantages of the present invention versus the known sealing means would be: the easy to manufacture shape and components of the closing and sealing elements while providing more effective lifting power of the poppet valve upon sudden negative air pressure within the sewage system and improved closing accuracy and sealing capacity of the air admittance valve in either balanced air conditions or any possible positive air pressure within the sewage system.

The purpose of the embodiments described herewith is only to illustrate the invention while still other variations are possible without falling out of the scope of the invention as expressed in the following claims.

LEGEND OF THE REFERENCE NUMERALS

10: air admittance valve housing
12: tubular member
14: upper cap of the housing
16: passageway towards surrounding atmosphere
18: passageway towards the inner space of sewage system
19: inner space of tubular member 12
20: central circular opening
21: closing wall of the housing 10
22: fixed sealing member
24: movable closing member
26: lower surface of the closing member
28: upper surface of the closing member
30: inner valve space connected with passageways 16
32: space within cap 14 connected with passageways 18
40: inverse poppet valve
42: lower part of poppet valve
44: inverse angled conical surface
45: upper edge
46: tubular extension
48: fixed vertical stem
50: annular soft seat
52: cantilever lip
54: rigid ring
55: fingers
56: latches

The invention claimed is:

1. An air admittance valve to be connected to a sanitary waste pipe system for admitting atmospheric air into the waste pipe system towards a valve sealing means in response to a sudden pressure reduction in the systems in order to protect the water traps in the system and to prevent discharge of contaminated air from the system to the atmosphere, the air admittance valve including a valve housing having:

a vertical tubular member adapted to be connected to the sanitary waste pipe system and having a first inner space;

a cover or cap at an upper end of the valve housing and having a second inner space;

a valve opening having a periphery and a valve seat provided with a soft annular seat at the periphery of the valve opening, situated between the tubular member and the cover, said valve seat being adapted to co-operate with a movable closing member having an upper surface and a lower surface;

at least one passageway leading from a third inner space of the housing towards the surrounding atmosphere;

at least another passageway leading from the second inner space within the housing towards the first inner space of the waste water pipe system;

said at least one and at least another passageways being respectively in contact with either the upper surface or the lower surface of the movable closing member so as to lift said movable closing member upon a sudden loss of air pressure in the sanitary waste pipe system allowing fresh air to enter into the system via the at least one passageway in order to balance the air pressure inside the sanitary waste pipe system, wherein the movable closing member comprises a rigid movable member having the shape of a circular poppet valve provided with an inverted bowl shaped inner part, and wherein the movable closing member is further provided with a conical peripheral collar having an inverse angled conical surface extending upwards.

2. An air admittance valve, according to claim 1, wherein the inverted bowl shaped inner part of the movable closing member having the shape of a circular poppet valve is provided with an upper center area which extends at a horizontal level which is higher than the level of an upper peripheral edge of the inverse angled conical surface.

3. An air admittance valve, according to claim 2, wherein a lower surface of the inverted bowl shaped inner part has a center provided with a tubular extension designed to co-operate with a vertical stem, rigidly connected to a wall part of the valve housing, for guiding purposes.

4. An air admittance valve, according to claim 3, wherein the vertical stem is provided with a star shaped outer surface when seen in cross section in order to reduce friction between the tubular extension of the poppet valve and the outer surface of the vertical stem.

5. An air admittance valve, according to claim 1, wherein the inverse angled conical surface of the peripheral edge extends upwards under an angle between 20.degree. and 45.degree.

6. An air admittance valve, according to claim 1, wherein the inverse angled conical surface of the peripheral edge extends upwards under an angle of about 30.degree.

7. An air admittance valve, according to claim 1, wherein the inverse angled conical surface of the peripheral edge extends upwards following a curved circle with a radius.

8. An air admittance valve, according to claim 7, wherein, the radius of the curved circle of the inverse angled conical surface equals about a diameter of the valve opening.

9. An air admittance valve, according to claim 1, wherein the rigid movable member in the shape of a circular poppet valve is manufactured in a rigid plastic material.

10. An air admittance valve, according to claim 1, wherein the rigid movable member in the shape of a circular poppet valve is manufactured in a material selected from the group consisting of polypropylene acrilonitrile-butadiene-styrene.

11. An air admittance valve, according to claim 1, wherein a lower surface of the inverted bowl shaped inner part of the movable member having the shape of a circular poppet valve is in permanent contact with the atmospheric air pressure, the upper surface being in contact with the inner space pressure of the sanitary waste pipe system.

12. An air admittance valve, according to claim 1, wherein the upper edge of the valve seat is provided with a soft annular seat having a thin annular cantilever platform or lip extending towards a center of the valve opening.

13. An air admittance valve, according to claim 12, wherein the soft annular seat is manufactured in a rubber material.

14. An air admittance valve, according to claim 13, wherein the soft annular seat is manufactured of nitril butadiene rubber.

15. An air admittance valve, according to claim 12, wherein the soft annular seat is clamped towards the upper edge of the valve seat by means of a rigid ring fixed onto the valve housing.

16. An air admittance valve, according to claim 15, wherein the rigid ring is clamped onto a lower side of a closing wall of the valve housing by means of a set of resilient latches provided at the lower extremity of fingers extending downwards from the ring.

* * * * *